US010580275B2

(12) United States Patent
Chen

(10) Patent No.: US 10,580,275 B2
(45) Date of Patent: Mar. 3, 2020

(54) ANTI-THEFT ELECTRONIC SEAL

(71) Applicant: Chih-Chuan Chen, Nantou (TW)

(72) Inventor: Chih-Chuan Chen, Nantou (TW)

( * ) Notice: Subject to any disclaimer, the term of this patent is extended or adjusted under 35 U.S.C. 154(b) by 87 days.

(21) Appl. No.: 15/919,227

(22) Filed: Mar. 13, 2018

(65) Prior Publication Data

US 2019/0287362 A1 Sep. 19, 2019

(51) Int. Cl.
*G08B 13/24* (2006.01)
*E05B 73/00* (2006.01)
*E05B 39/00* (2006.01)

(52) U.S. Cl.
CPC ..... *G08B 13/2448* (2013.01); *E05B 39/00* (2013.01); *E05B 73/0017* (2013.01); *G08B 13/2417* (2013.01); *G08B 13/2474* (2013.01)

(58) Field of Classification Search
CPC ..... G08B 13/2448; G08B 13/2474; G08B 13/2417; E05B 73/0017; E05B 39/00; E05B 73/00
USPC ..... 343/720
See application file for complete search history.

(56) References Cited

U.S. PATENT DOCUMENTS 3,911,534 A * 10/1975 Martens ..... E05B 73/00 70/57.1
3,947,930 A * 4/1976 Martens ..... E05B 73/0017 340/572.7
3,974,581 A * 8/1976 Martens ..... E05B 73/0017 340/572.7
4,012,813 A * 3/1977 Martens ..... E05B 73/0017 70/57.1
4,502,717 A * 3/1985 Close ..... E05B 73/0064 70/57.1
5,347,262 A * 9/1994 Thurmond ..... E05B 73/0017 340/505
6,222,439 B1 * 4/2001 Tanigawa ..... H01H 39/006 180/279
7,347,068 B2 * 3/2008 Seidel ..... E05B 73/0017 206/1.5
2009/0091144 A1 * 4/2009 Debrody ..... G09F 3/0317 292/327
2016/0168877 A1 * 6/2016 Chen ..... G09F 3/0317 70/14

* cited by examiner

*Primary Examiner* — Hai V Tran
(74) *Attorney, Agent, or Firm* — Leong C. Lei

(57) ABSTRACT

A bolt includes a conductor having an accommodation hole and a circuit board installed in the accommodation hole, where the upper part of the conductor is covered with an insulating sleeve, and the lower part thereof is configured with a first engagement portion, a RFID chip and lower contact of the circuit board is formed into a control circuit, and the lower contact is allowed to be protruded out of the bottom end of the accommodation hole. An antenna and elastic sheet are configured inside the bolt seat, and the outer peripheral thereof is configured with an insertion hole and second engagement portion adapted to position the first engagement portion, the elastic sheet have a pre-pressure to allow the antenna, control circuit and conductor to be in electric connection with one another. Whereby, the electric connection can be interrupted when the bolt is cut.

13 Claims, 10 Drawing Sheets

ANTI-THEFT ELECTRONIC SEAL

TECHNICAL FIELD OF THE INVENTION

The present invention relates to an anti-theft electronic seal capable of disconnecting an electric connection in advance before a burglar forces a bolt to rotate to destroy a first or second engagement portion.

DESCRIPTION OF THE PRIOR ART

One of the newest electronic seal technologies is for example U.S. Pat. No. 9,508,271 B2, titled "Electronic bolt seal", allowing an electric connection of the electronic bolt seal to be automatically disrupted so that a customers identification host can be warned through electromagnetic wave identification when a burglar grinds a bolt head of the casing. However, it poses the following shortcomings:

1. the first or second fastening elements will be destroyed, and the bolt and bolt seat are then separated when a burglar uses an electric tool (electric drill) to force the bolt to rotate continuously about the bolt seat; subsequently, the burglar can open the container door latch to conduct theft or replacement; thereafter, the burglar simply plugs the bolt back to the bolt seat, and buckles it back on the container door latch; whereby, the electronic seal is allowed to be operated normally as usual, causing the customer identification host to be unable to emit a warning; and
2. after an electronic seal is produced, quality control personnel need to feedback test through an identification host, but the identification host is not cheap and cannot be purchased in a larger number, causing the quality control efficiency not to be able to be increased.

SUMMARY OF THE INVENTION

The present invention is characterized in that the antenna is constituted by a glue layer of an elastic sheet and a metal layer covered on the glue layer, in combination with the bolt seat, the elastic sheet can provide a pre-pressure for the antenna when the bolt and bolt seat is positioned with the first, second engagement portions, allowing a lower contact of a circuit board and the metal layer to be powered on, and when the bolt is forced to rotate around an insertion hole, the circuit or lower contact is controlled to scratch the metal layer to form a short-circuit ring area, thereby interrupting the electric connection to allow the electronic seal to keep a warning function and the deficiencies of the above patent to be improved.

DETAILED DESCRIPTION OF THE PREFERRED EMBODIMENTS

Figure 6:
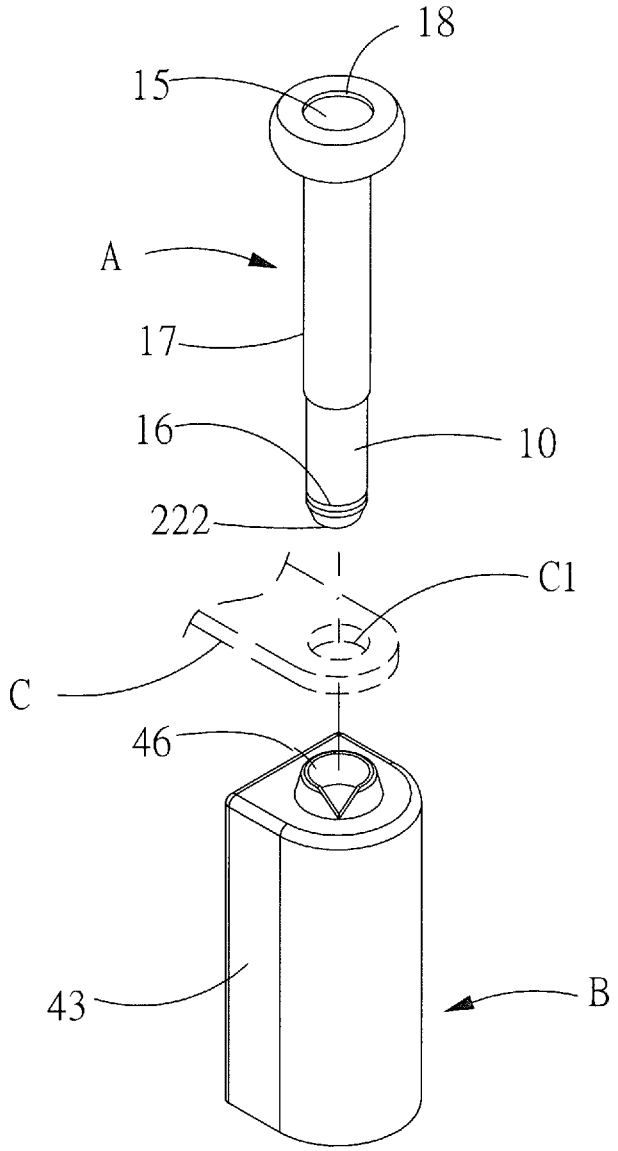
FIGS. 6 and 7 respectively show the relative positions of the bolt, a container door latch and the bolt seat.
Figure 7:
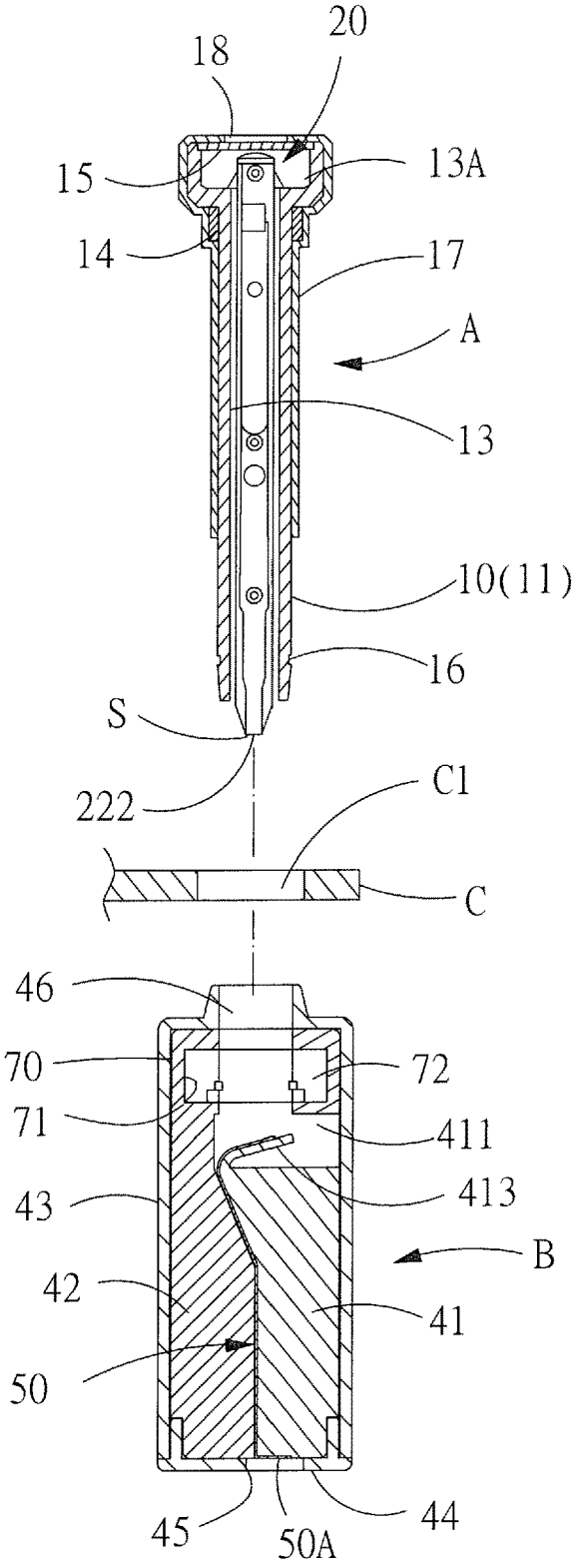
Figure 8:
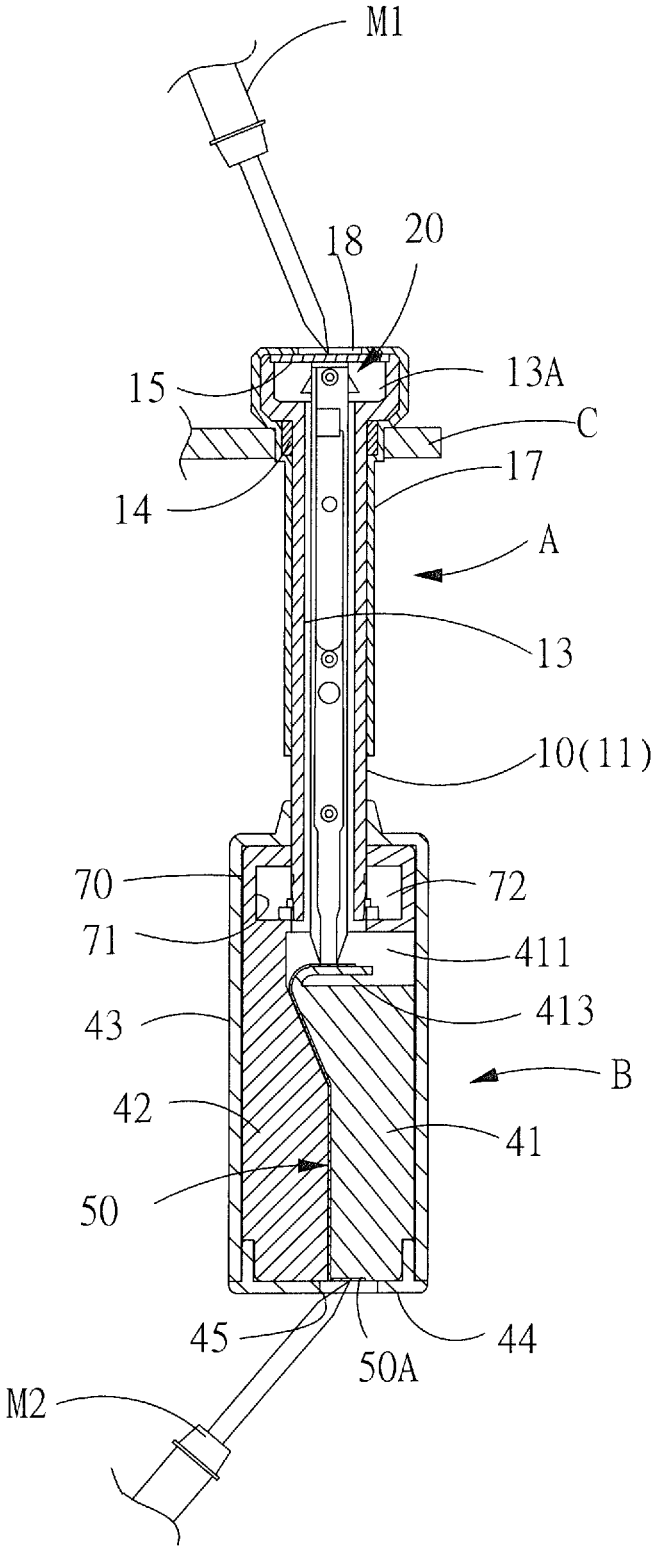
FIG. 8 shows an instrument used to carry out a quality control test according to the present invention.

Referring to FIGS. 6 and 8, an electronic seat of the present invention is constituted by a bolt A and bolt seat B, where the bolt A can be plugged into bolt seat B from top to bottom and thus locks a latch hole C1 of a container door latch C, allowing a customers identification host to judge whether the container is opened normally.

Referring to FIGS. 1 to 8, the bolt A is mainly constituted by a conductor 10, circuit board 20 and insulating inner rod 30, where the conductor 10 has a rod body 11, cap head 12 radially expanded outward from the top end of the rod body 11, accommodation hole 13 passed through the top face and bottom face of the rod body 11, collar 14 pressed against the bottom end of the cap head 12, where the diameter of the cap head 12 is large enough to allow it to be abutted against the door latch C. Furthermore, the top edge of the accommodation hole 13 further has a countersink 13A with a larger diameter, and the top edge of the countersink 13A is configured with a positioning hole 13B with a much larger diameter allowing an electrically conductive upper cover 15 to seal; the lower outer peripheral of the conductor 10 is further encircled with a concave first engagement portion 16, and the upper outer peripheral thereof is formed with an insulating sleeve 17 adapted to cover the collar 14 and upper cover 15. In addition, a upper test area 8 maintaining exposing a part of the top face of the upper cover 13 is further recessed on the top end of the insulating sleeve 17.

The circuit board 20 is hung inside the accommodation hole 13 through the insulating inner rod 30 fixed on the back face thereof, the bottom face of a necking 21 is allowed to be protruded out of the bottom end of the accommodation hole 13, and a circuit wiring 221, lower contact 222, radio frequency identification (RFID) chip 223 and battery 224 are used to constitute a control circuit 22, where the lower contact 222 is arranged on the rectangular bottom face of the necking 22, allowing it to have a tendency to be protruded out of the bottom end of the accommodation hole 13. Furthermore, the corner of the lower contact 222 of the bottom end of the circuit board 20 is further extended with a needle S, the bottom end of which is protruded downward out of the lower contact 222. The inner rod 30 has an elastic portion 32 adapted to buckle the countersink 13A and the bottom face of the upper cover 15, thereby hanging the circuit board 20 elastically inside the accommodation hole 13.

Referring to FIGS. 1 to 8 again, the bolt seat B is constituted by combining a first shell seat 41 with a second shell seat 12 face to face, and then inserting them into a hollow outer shell 43, and sealing the bottom end of the outer shell 43 with a bottom cover 44, through which a lower test area 45 adapted to power on the bottom end of the first shell seat 41 is further passed, and the upper part of the combined first and second shell seats 41, 42 of the bolt seat B is formed into an insertion hole 46, in which the lower part of the conductor 10 can be plugged. Furthermore, the first shell seat 41 further has a hollowed area 411 in communication with the bottom end of the insertion hole 46, the bottom end of which is extended downward with a wedge-shaped bonding face 412, the top end of which is further extended with an elastic sheet 412 inclined in the hollowed area 411, where an antenna 50 is allowed to be installed on the bonding face 412, elastic sheet 413 and the bottom end of the first shell seat 41.

Figure 1:
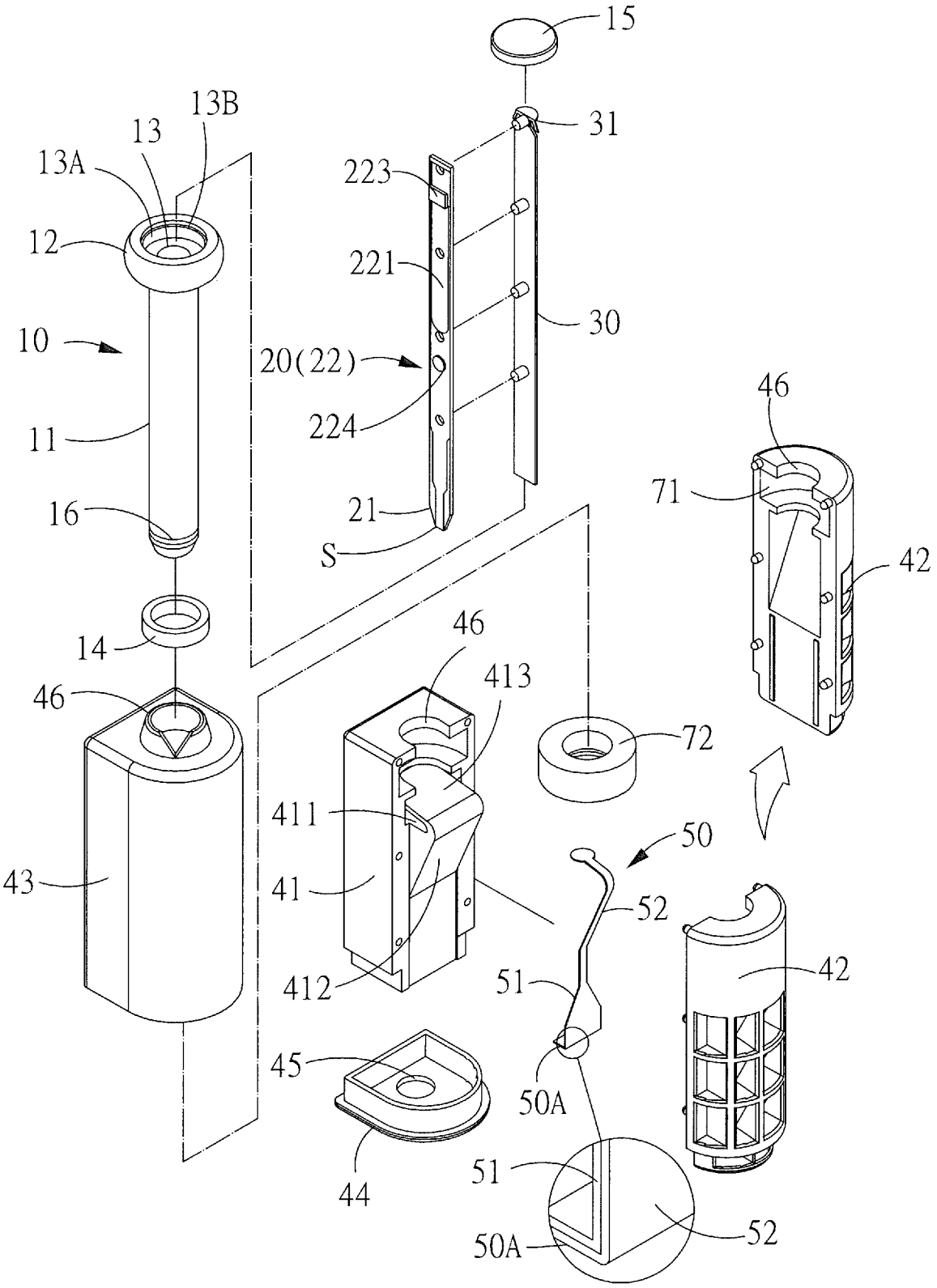
FIG. 1 is an exploded view of the present invention.
Figure 2:
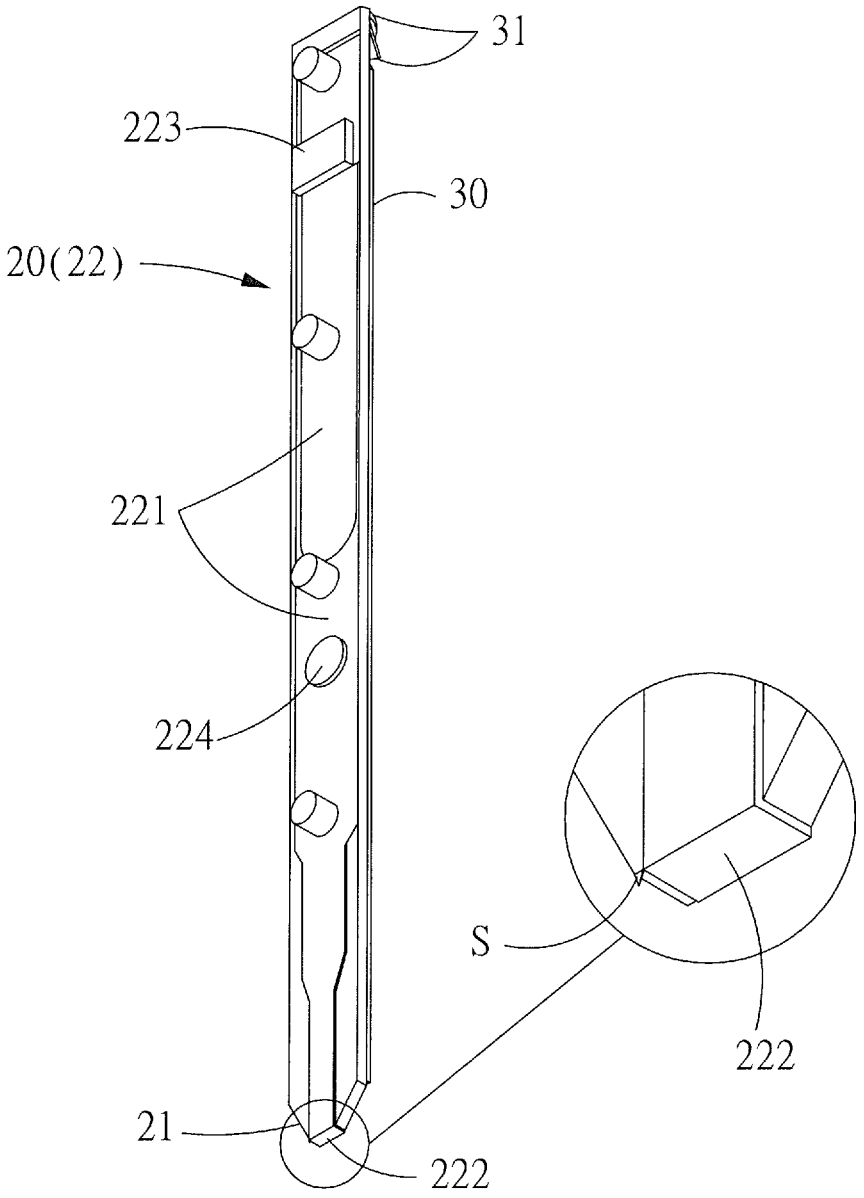
FIG. 2 is a schematically perspective view of a circuit board of the present invention.
Figure 3:
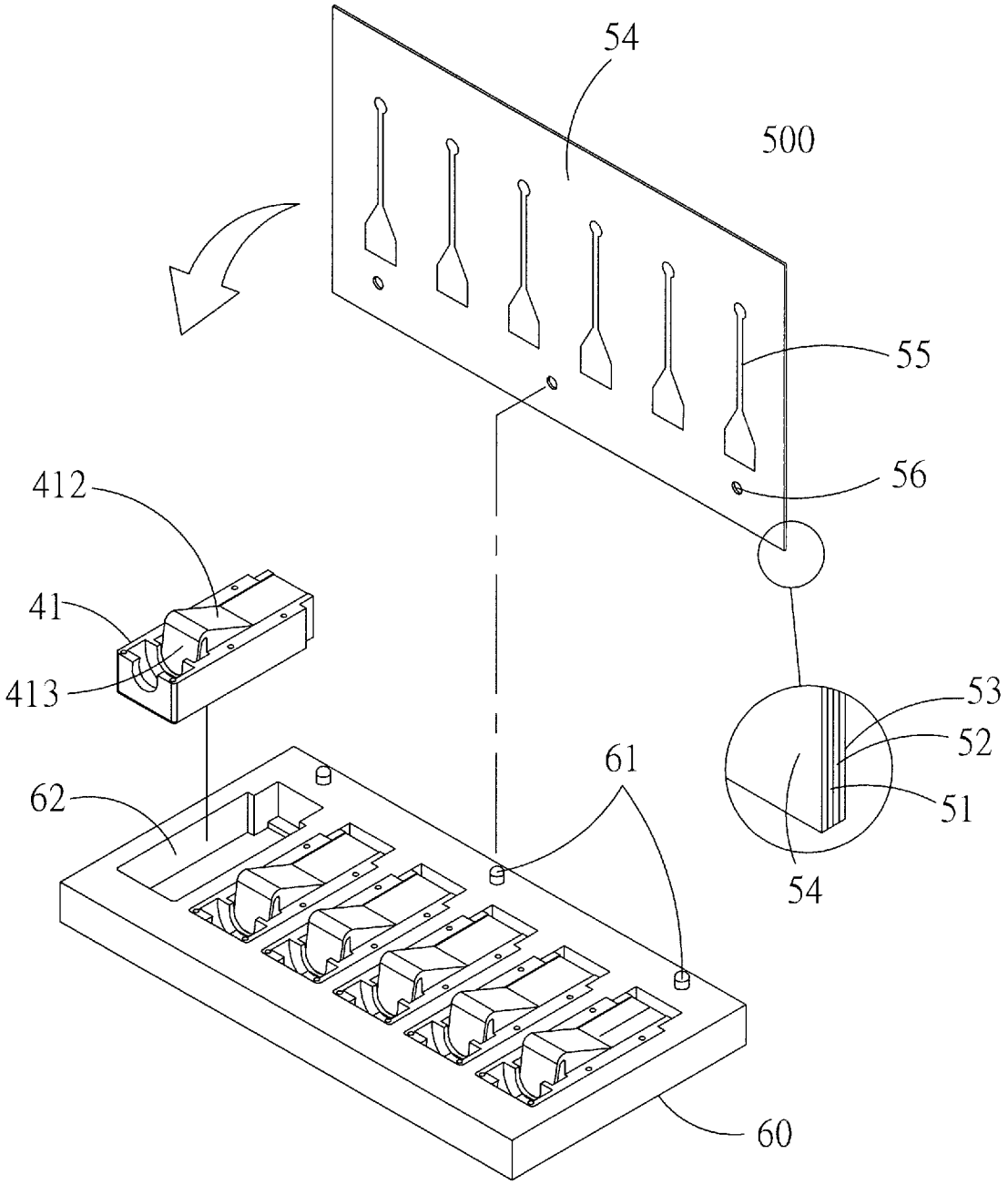
FIGS. 3, 4 and 5 respectively are a step of the process of the installment of an antenna on a bolt seat according to the present invention.
Figure 4:
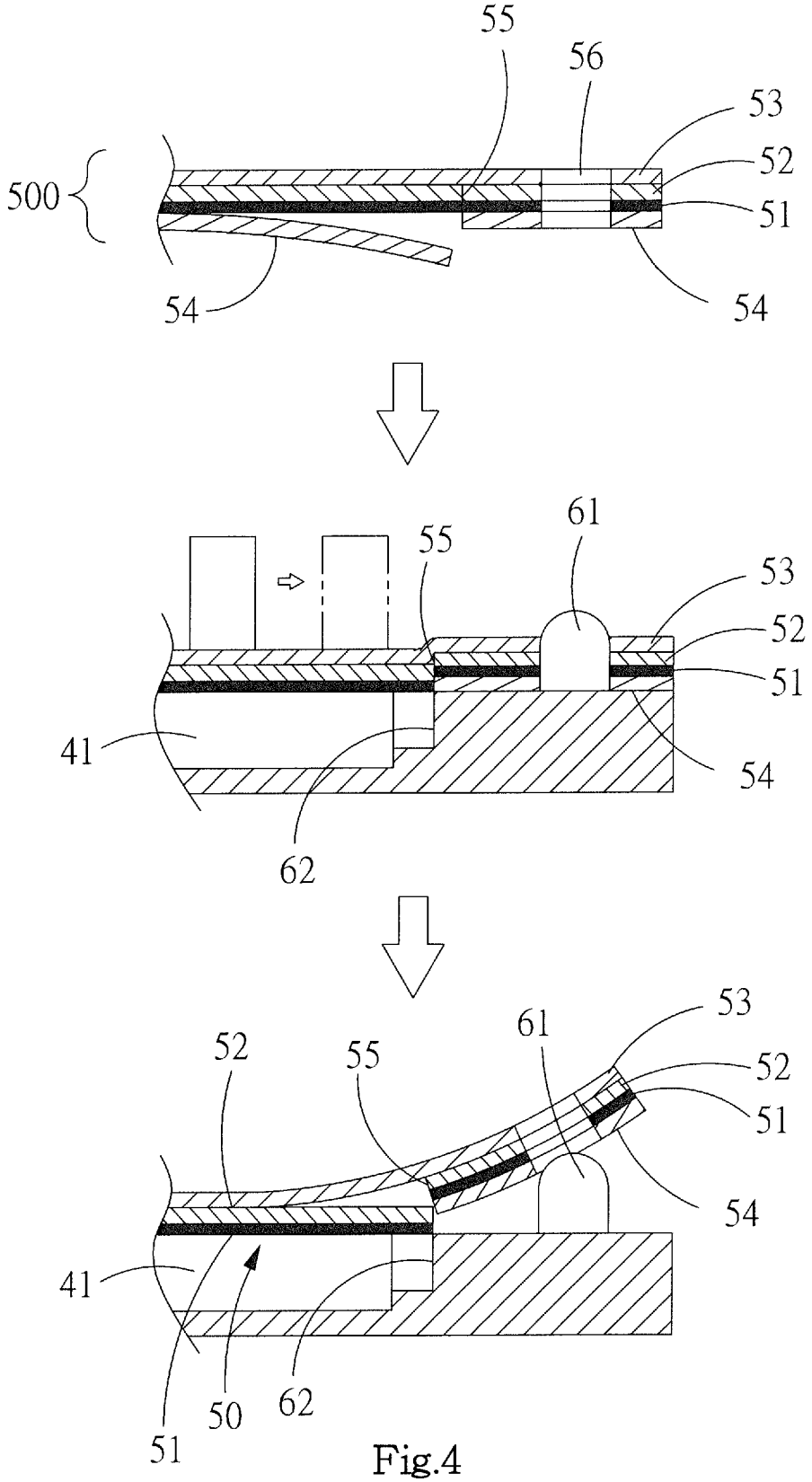
Figure 5:
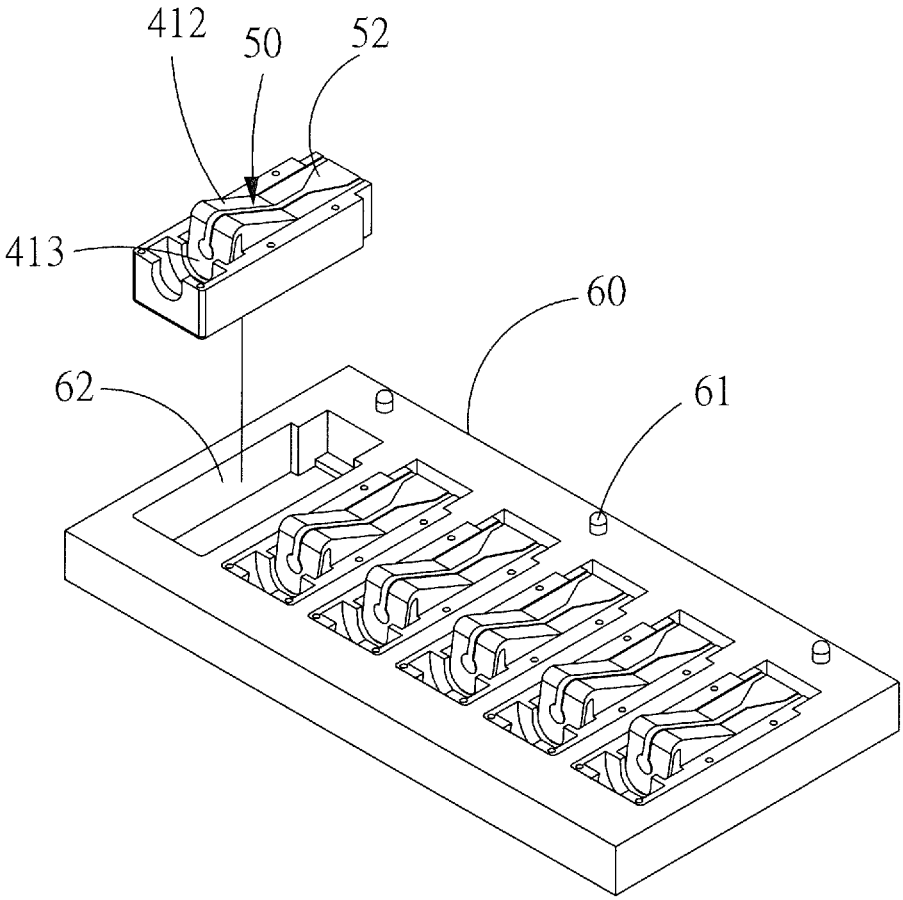

The antenna 50 is at least constituted by a glue layer 51 and metal layer 52, where the glue layer 51 is stuck on the bonding face 412, elastic sheet 413 and the bottom end of the first shell seat 41, and the metal layer 52 is covered on the glue layer 51. Furthermore, the hardness of the lower contact 22 is further set to be larger than the one of the metal layer 52. The antenna 50, as FIGS. 3 to 5 show, is still made of a four-layer sticker 500 formed by stacking a light-transmissive layer 53, metal layer 52, glue layer 51 and separation layer 54 together in sequence. Thereafter, the back face of the separation layer 54 is cut into several contour lines 55 penetrated a depth up to the metal layer 52, where the contour line 55 is shaped to match the antenna, and the sticker 500 is further passed through with alignment holes 56 on proper positions thereof, where the alignment hole 56 is matched with a corresponding alignment pin 61 of a jig 60, and the jig 60 is further configured with mold holes 62 each corresponding to one of the contour lines 55, where the mold hole 62 allows the first shell seat 41 to be positioned. First, the separation layer 54 inside the range of the each contour line 55 is torn off, and the alignment holes 56 are then caused to be in engagement with the corresponding alignment pins 61. Next, the light transmissive layer 55 at the position where the separation layer 54 is torn off, and the metal layer 52, glue layer 51 can then be transferred onto the bonding face 412 and elastic sheet 413. Subsequently, the remnant of the sticker 500 is moved away and the first shell seats 41 are demolded. Finally, a fold edge 50A of the antenna 50 is stuck to the bottom end of the first shell seat 41, allowing the lower test area 45 to keep exposing a part of the fold edge 50A of the antenna 50, and the antenna 40 of each first shell seat 41 can thus be easily installed.

The bolt seat B is configured with a second engagement portion 70 extended radially outward with an annular groove 71 from the insertion hole 46, where the annular groove 71 is installed with a buckle ring 72, thereby allowing the first engagement portion 16 to be positioned by the buckle ring 72 after the bolt A is plugged in the latch hole C1 and insertion hole 46 in sequence, and being used to lock the container door latch C. At this time, the elastic sheet 413 of the bolt seat B is allowed to provide a pre-pressure F so as to control the antenna 50 to be in contact with the lower contact 222, and allow the needle S to be at least pierced through the metal layer 52 and overcome the elastic portion 31 to push the circuit board 20 to move upward, allowing the control circuit 22 to be in electric connection with the upper cover 15, conductor 10 and antenna 50 (this technology has been disclosed in the patent mentioned above, such that the detail is omitted here) to allow the RFID chip 223 to emit the set identification electromagnetic wave so as to provide customers with an identification host automatic management. But, if a burglar cut the bolt A to steal or replace cargo inside a container, the circuit board 20 will form a short circuit to interrupt the electric connection, allowing the customers identification host to judge the container has been in an abnormal state.

Referring to FIG. 8, when quality control personnel need to test whether the circuit board 20 inside the bolt A is in electric with the antenna 50 and conductor 10 through the bolt in combination with the bolt seat B after the products of the present invention is made, the upper test area 18 of the present invention allows the positive probe Ml of a multimeter to be in contact with the upper cover 15 and the lower test area 45 allows the negative prove the fold edge 50A of the antenna 50 so that whether the electric connection is in a normal state can then be easily tested. Therefore, the upper test area 18 and lower test area 45 of the present invention allow a feedback test of an instrument such as a multimeter. Whereby, the instrument purchase cost of multimeters can be far lower than the one of current identification host such that they can be purchased in a large amount, allowing the quality control efficiency to be matched with the production efficiency.

Figure 9:
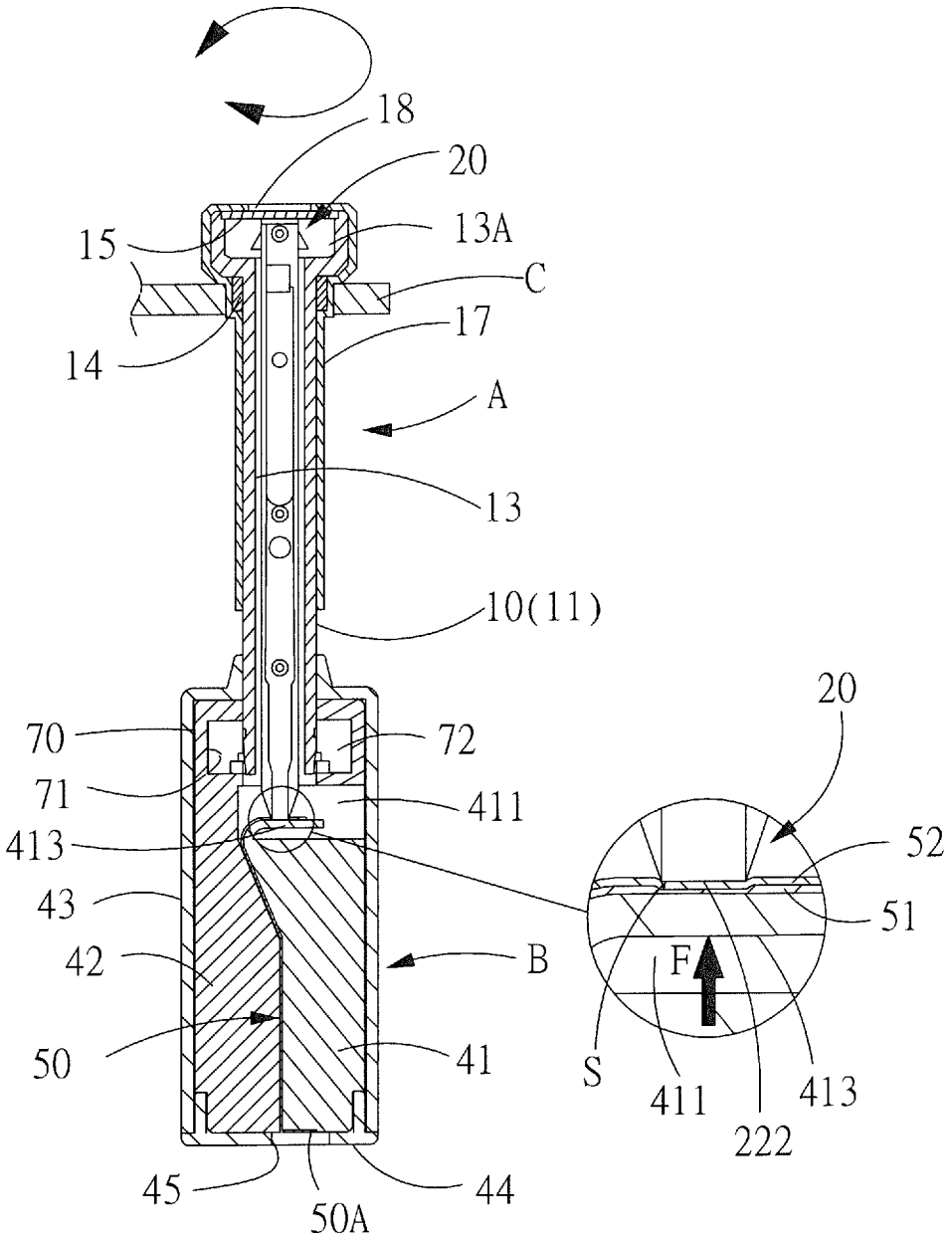
FIG. 9 is a cross-sectional view of the bolt in combination with the bolt seat according to the present invention' and FIG. 10 shows a metal layer of the antenna is scratched by forcing the rotation of the bolt according to the present invention.
Figure 10:
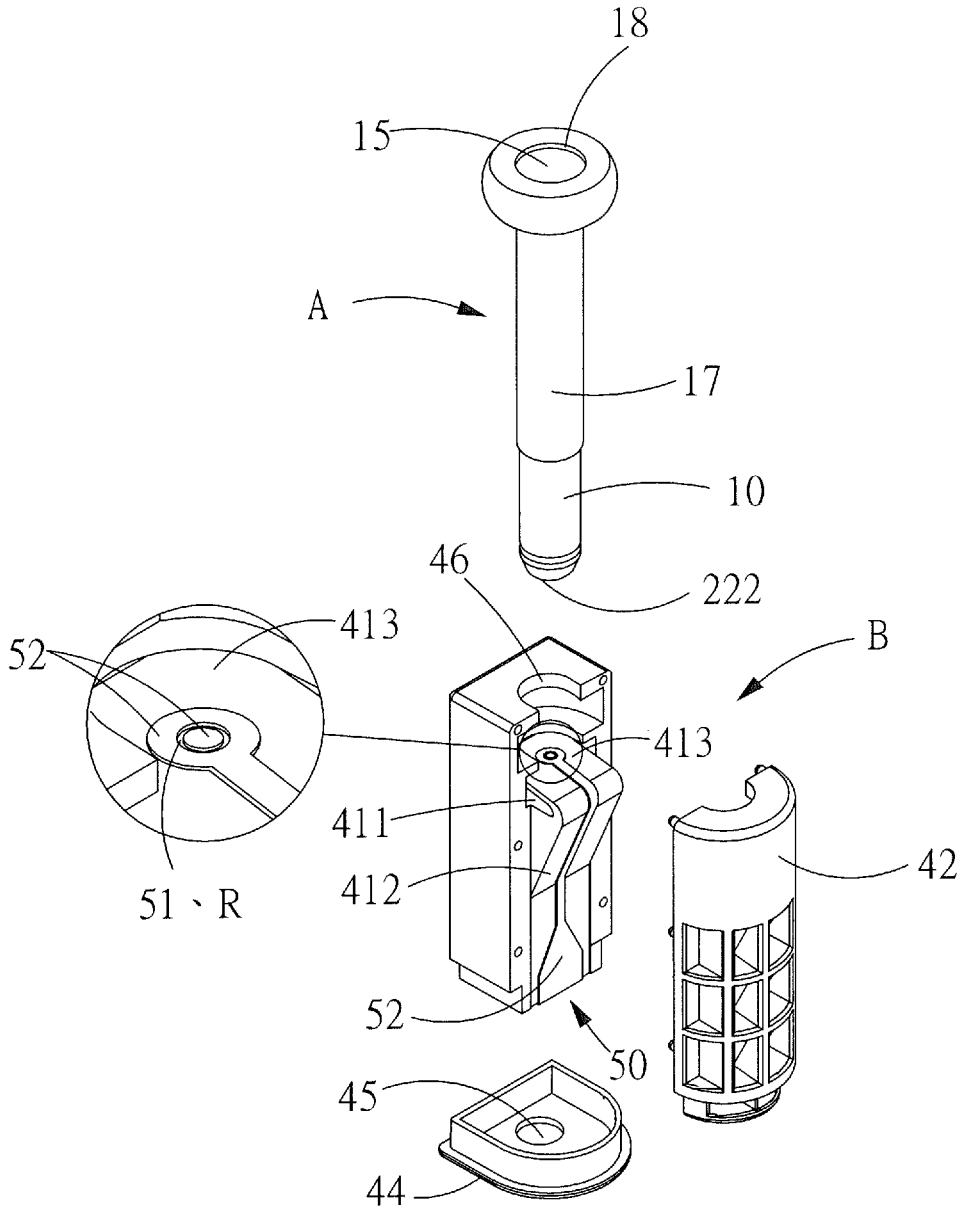

Referring to FIGS. 9 and 10, if a burglar uses a electric tool (such as an electric drill) to force the continuous rotation of the bolt A, and thereby to destroy the positioning of the first engagement portion 16 and second engagement portion 70 and further separate the bolt A from the bolt seat B to conduct theft or replacement. The needle S will be driven to scratch the metal layer 52 because the needle S has been pierced through the metal layer 53 at the time of forcing the continuous rotation of the bolt A, thereby forming a short-circuit ring area R, and thus interrupting the above electric connection so as to warn the identification host effectively. In addition, even if the present invention is arranged to have no needle S to pierce through the metal layer 52, the corner of the lower contact 222 can still scratch the metal layer 52, allowing the metal layer 52 to form the short-circuit ring area R under two important conditions of setting the hardness of the lower contact 22 to be larger the one of the metal layer 52 and controlling the pre-pressure F of the elastic sheet 413 to be large enough to allow the corner of the lower contact 222 to scratch the metal layer 52.

I claim:

1. An anti-theft electronic seal, comprising:

a bolt, constituted by a conductor and circuit board, said conductor having an accommodation hole passed through a bottom face thereof, an outer peripheral of a upper part thereof covered with an insulating sleeve, a peripheral of a lower part of said conductor configured with a first engagement portion, said circuit board installed inside said accommodation hole, and a circuit wiring, radio frequency identification (RFID) chip and lower contact forming a control circuit, a bottom end of said lower contact allowed to protrude out of said accommodation hole; and a bolt seat, an antenna and elastic sheet configured inside said bolt seat, said bolt seat having an insertion hole allowing the lower part of said conductor to be plugged therein and a second engagement portion for the positioning of said first engagement portion, said elastic sheet further controlled to provide a pre-pressure for said antenna and circuit board, allowing said antenna, control circuit and conductor to be in electric connection with one another, said electric connection disconnected when said electric connection is cut, said antenna constituted by glue layer in combination with said antenna and a metal layer in contact with said lower contact, and said circuit board or lower contact further driven to scratch said metal layer to form a short-circuit ring area when said bolt is forced to rotate around said insertion hole, thereby disconnecting said electric connection.

2. The electronic seal according to claim 1, wherein hardness of said lower contact is larger than the one of said metal layer so as to make said pre-pressure allowance of said elastic sheet enough to allow a corner of said lower contact to scratch said metal layer to cause said metal to form said short-circuit ring area when said antenna, control circuit and conductor are in electric connection with one another and said bolt is forced to rotate continuously.

3. The electronic seal according to claim 2, wherein said bolt further defines a upper test area maintaining exposing a part of an outer peripheral of said conductor, and an outer peripheral of said bolt seat is recessed with a lower test area maintaining exposing a part of said antenna, allowing said upper test area and lower test area to be in contact with an instrument, and said instrument detects said electric connection when said antenna, control circuit and conductor are in the electric connection with one another.

4. The electronic sheet according to claim 3, wherein said accommodation hole is passed through a top face and bottom face of said conductor, a top edge of said accommodation hole has a countersink, a top edge of said countersink is configured with a positioning hole allowing an electrically conductive upper cover to be sealed, and said insulting sleeve is recessed with said upper test area maintaining exposing a part of a top face of said upper cover, said circuit board is further configured with an insulating inner rod having an elastic portion capable of buckling said countersink and a bottom face of said upper cover adapted to hang said circuit board in said accommodation hole; said bolt seat is formed by combining a first shell seat with a second shell seat face to face, then inserted in a hollow outer shell, and sealing a bottom end of said outer shell with a bottom cover; said bottom cover is further passed through with a lower test area in communication with a bottom end of said first shell seat, a upper part of said first shell seat and second shell seat combined with each other face to face has the insertion hole allowing the lower part of said conductor to be plugged therein, said first shell seat further has a hollowed area in communication with a bottom end of said insertion hole, a bottom end of said hollowed are is extended downward with a bonding face, a top end of said bonding face is configured with an elastic sheet, said bonding face, elastic sheet allow said antenna to be installed thereon, said antenna is installed on a bottom end of said first shell seat with a fold edge thereof, and said lower test area maintains exposing a part of said fold edge.

5. A method for making an anti-theft electronic seal, comprising the following steps:

providing said bolt and bolt seat according to claim 2;

allowing an antenna to be made of a four-layer sticker formed by a light-transmissive layer, metal layer, glue layer and separation layer stacked in sequence from top to bottom;

cutting a number of contour lines having a depth through said metal layer on a back face of said separation layer, said contour line corresponding to an antenna in shape:

tearing down said separation layer in a range of each contour line; and pressing said light-transmissive layer in a range of each contour line downward, thereby transferring said metal layer and glue layer onto said bolt seat in order to complete the installment of said antenna.

6. The method according to claim 5, wherein a sticker is further configured with through positioning holes matched with corresponding positioning pins of a jig, and said jig is further configured with mold holes each corresponding to one of said contour lines and adapted to provide the positioning of said bolt seat for the installment of said antenna.

7. The electronic seal according to claim 1, wherein a bottom end of said circuit board is further extended with a needle, a bottom end of said needle is protruded downward out of said lower contact so as to allow said needle to be able to be pierced through said metal layer when said antenna, control circuit and conductor is in the electric connection with one another, and said needle is driven to scratch said metal layer to form said short-circuit ring area when said bolt is forced to rotate continuously.

8. The electronic seal according to claim 7, wherein said bolt further defines a upper test area maintaining exposing a part of an outer peripheral of said conductor, and an outer peripheral of said bolt seat is recessed with a lower test area maintaining exposing a part of said antenna, allowing said upper test area and lower test area to be in contact with an instrument, and said instrument detects said electric connection when said antenna, control circuit and conductor are in the electric connection with one another.

9. The electronic sheet according to claim 8, wherein said accommodation hole is passed through a top face and bottom face of said conductor, a top edge of said accommodation hole has a countersink, a top edge of said countersink is configured with a positioning hole allowing an electrically conductive upper cover to be sealed, and said insulting sleeve is recessed with said upper test area maintaining exposing a part of a top face of said upper cover, said circuit board is further configured with an insulating inner rod having an elastic portion capable of buckling said countersink and a bottom face of said upper cover adapted to hang said circuit board in said accommodation hole; said bolt seat is formed by combining a first shell seat with a second shell seat face to face, then inserted in a hollow outer shell, and sealing a bottom end of said outer shell with a bottom cover; said bottom cover is further passed through with a lower test area in communication with a bottom end of said first shell seat, a upper part of said first shell seat and second shell seat combined with each other face to face has the insertion hole allowing the lower part of said conductor to be plugged therein, said first shell seat further has a hollowed area in communication with a bottom end of said insertion hole, a bottom end of said hollowed are is extended downward with a bonding face, a top end of said bonding face is configured with an elastic sheet, said bonding face, elastic sheet allow said antenna to be installed thereon, said antenna is installed on a bottom end of said first shell seat with a fold edge thereof, and said lower test area maintains exposing a part of said fold edge.

10. The electronic seal according to claim 1, wherein said bolt further defines a upper test area maintaining exposing a part of an outer peripheral of said conductor, and an outer peripheral of said bolt seat is recessed with a lower test area maintaining exposing a part of said antenna, allowing said upper test area and lower test area to be in contact with an instrument, and said instrument detects said electric connection when said antenna, control circuit and conductor are in the electric connection with one another.

11. The electronic sheet according to claim 10, wherein said accommodation hole is passed through a top face and bottom face of said conductor, a top edge of said accommodation hole has a countersink, a top edge of said countersink is configured with a positioning hole allowing an electrically conductive upper cover to be sealed, and said insulting sleeve is recessed with said upper test area maintaining exposing a part of a top face of said upper cover, said circuit board is further configured with an insulating inner rod having an elastic portion capable of buckling said countersink and a bottom face of said upper cover adapted to hang said circuit board in said accommodation hole; said bolt seat is formed by combining a first shell seat with a second shell seat face to face, then inserted in a hollow outer shell, and sealing a bottom end of said outer shell with a bottom cover; said bottom cover is further passed through with a lower test area in communication with a bottom end of said first shell seat, an upper part of said first shell seat and second shell seat combined with each other face to face has the insertion hole allowing the lower part of said conductor to be plugged therein, said first shell seat further has a hollowed area in communication with a bottom end of said insertion hole, a bottom end of said hollowed are is extended downward with a bonding face, a top end of said bonding face is configured with an elastic sheet, said bonding face, elastic sheet allow said antenna to be installed thereon, said antenna is installed on a bottom end of said first shell seat with a fold edge thereof, and said lower test area maintains exposing a part of said fold edge.

12. A method for making an anti-theft electronic seal, comprising the following steps:

providing said bolt and bolt seat according to claim 1;

allowing an antenna to be made of a four-layer sticker formed by a light-transmissive layer, metal layer, glue layer and separation layer stacked in sequence from top to bottom;

cutting a number of contour lines having a depth through said metal layer on a back face of said separation layer, said contour lines corresponding to said antenna in shape:

tearing down said separation layer in a range of each contour line; and pressing said light-transmissive layer in a range of each contour line downward, thereby transferring said metal layer and glue layer onto said bolt seat in order to complete the installment of said antenna.

13. The method according to claim 12, wherein said sticker is further configured with through positioning holes matched with corresponding positioning pins of a jig, and said jig is further configured with mold holes each corresponding to one of said contour lines and adapted to provide the positioning of said bolt seat for the installment of said antenna.

* * * * *